United States Patent [19]

Stanislaw

[11] Patent Number: 4,830,351

[45] Date of Patent: May 16, 1989

[54] BATT STABILIZATION IN CROSS-LAPPED WEB MANUFACTURING APPARATUS

[75] Inventor: Peter P. Stanislaw, Bennington, Vt.

[73] Assignee: Morrison Berkshire, Inc., North Adams, Mass.

[21] Appl. No.: 148,848

[22] Filed: Jan. 27, 1988

[51] Int. Cl.[4] ..... B65H 29/46

[52] U.S. Cl. ..... 270/31

[58] Field of Search ..... 270/30, 31, 39; 19/163, 19/160

[56] References Cited

U.S. PATENT DOCUMENTS

| | | | |
|---|---|---|---|
| 3,842,465 | 10/1974 | Sillaots et al. | 19/163 |
| 3,877,628 | 4/1975 | Asselin et al. | 270/30 |
| 3,903,568 | 9/1975 | Watson | 19/163 |
| 4,279,610 | 7/1981 | Reba | 270/30 |
| 4,357,739 | 11/1982 | Hille | 19/163 |

FOREIGN PATENT DOCUMENTS

| | | | |
|---|---|---|---|
| 1243035 | 8/1960 | France | 19/163 |

*Primary Examiner*—Robert E. Garrett
*Assistant Examiner*—Therese M. Newholm
*Attorney, Agent, or Firm*—Lerner, David, Littenberg, Krumholz & Mentlik

[57] ABSTRACT

An apparatus for forming a layered, cross-lapped web of predetermined width from a strip of batt material is disclosed. The apparatus comprises a pair of transversely spaced frame members, a delivery conveyor having a web support surface thereon positioned between the frame members and movable longitudinally relative thereto, a cross-lapping carriage transversely reciprocatively movable relative to the delivery conveyor and adapted to deliver the strip of batt material to the support surface to form the layered cross-lapped web on the delivery conveyor, and shielding aprons carried by the cross-lapping carriage and statically juxtaposed above the layered web for shielding portions of the web adjacent to the cross-lapping carriage from air eddies caused by the transverse reciprocative movement of the cross-lapping carriage. The shielding aprons have variable length portions thereof extending from each side of the cross-lapping carriage to corresponding ones of the frame members during the transversely reciprocative movements of the cross-lapping carriage and they have essentially zero transverse movement relative to the portions of the layered web positioned therebeneath.

8 Claims, 8 Drawing Sheets

BATT STABILIZATION IN CROSS-LAPPED WEB MANUFACTURING APPARATUS

FIELD OF THE INVENTION

The present invention relates to apparatus for manufacturing cross-lapped webs and, more particularly, to such apparatus in which the batt used to manufacture such webs is stabilized as it is being added to the web.

BACKGROUND OF THE INVENTION

In current apparatus for forming cross-lapped webs, for example the machine shown in U.S. Pat. No. 3,558,029 to Manns, a thin, narrow width strip of carded material, herein referred to as "batt", is folded to convert it into a web which is thicker than the batt, and whose width is, as a rule, different from and usually greater than the width of the batt. Such known web manufacturing machines include a feed system for the batt, a guide system which receives the batt as it leaves the feed system and causes the batt to move along a loop-like path, and a delivery conveyor onto which the batt is placed as it leaves the guide system.

The guide system of the foregoing machine comprises two aprons or endless belts which run on rollers carried on upper and lower moving carriages that are transversely reciprocatively driven relative to the delivery belt. The aprons or belts of the guide system are driven relative to the carriages to move the batt strip through its path from the feed system to the delivery belt, and the delivery belt moves at a continuous rate of advance in a direction perpendicular to the directions of movement of the carriages. Consequently, the batt is placed on the delivery belt in consecutive transverse folds or plies. The relationship between the speed of the delivery belt and the speed of the lower carriage determines the number of overlapping folds and therefore the thickness of the final web. The width of the web is defined by the travel of the lower carriage.

One disadvantage of the foregoing known machine results from the reciprocation of the guide carriages. Such reciprocation produces air eddies above the delivery belt which, in turn, produces eddying of the batt and web on the delivery belt, leading to irregularities in the final web.

One attempt to overcome the air eddying problem may be found in U.S. Pat. No. 3,877,628 to Asselin et al. This patent also describes a machine for forming cross-lapped webs that includes upper and lower transversely reciprocative carriages, a delivery belt positioned beneath the lower carriage and longitudinally movable relative thereto for receiving the batt strip, and first and second guide aprons or conveyor belts which deliver the batt from a feeding device to the delivery belt. In this case the return runs of the guide aprons or belts are juxtaposed above the strip of batt being deposited on the delivery belt so as to shield the just delivered batt from air eddies.

The guide aprons or belts in the foregoing machine are separately driven relative to the cross-lapping carriage so that when the carriage is moving in one direction to deposit the batt strip on the delivery belt, the trailing run of the guide apron has a relative transverse speed of zero with respect to the batt strip being laid on the delivery belt; however, the guide apron on the opposite side of the carriage has a transverse speed relative to the batt strip and web thereunder that is twice the speed of the carriage. The latter guide apron thus drags across the fragile batt strip and web deposited thereunder, tending to disturb the same and making it impossible to achieve a uniform density profile in the web. This disadvantage is magnified if the dragging apron contains any contamination, such as dirt, fibers or oils, on its surface.

It is, therefore, a primary object of the present invention to provide improved apparatus for forming a layered, cross-lapped web of predetermined width from a strip of batt material.

Another object of the present invention is to provide an improved apparatus for forming a layered, cross-lapped web of predetermined width from a strip of batt material, in which the batt strip and web deposited on the delivery conveyor are shielded from air eddies generated by the movement of the cross-lapping carriage relative to the delivered batt.

A further object of the invention is to provide an improved apparatus for forming a layered, cross-lapped web of predetermined width from a strip of batt material, in which the batt strip being delivered by the cross-lapping carriage to the delivery conveyor and the fragile web on the delivery conveyor are shielded by aprons or conveyor belts that are transversely static relative to the deposited batt strip and web.

Additional objects and advantages of this invention will become apparent as the following descriptions proceeds.

SUMMARY OF THE INVENTION

Briefly stated and in accordance with one embodiment of this invention, an improved apparatus for forming a layered, cross-lapped web of predetermined width from a strip of batt material comprises a pair of transversely spaced frame members, a delivery conveyor means having a web support surface thereon positioned between the frame members and movable longitudinally relative thereto, a cross-lapping carriage transversely reciprocatively movable relative to the delivery conveyor and adapted to deliver the strip of batt material to the web support surface to form the layered cross-lapped web on the delivery conveyor, and shielding aprons carried by the cross-lapping carriage and statically juxtaposed above the layered web for shielding portions of the web adjacent to the cross-lapping carriage from air eddies caused by the transverse reciprocative movement of the cross-lapping carriage. The shielding aprons have variable length portions thereof extending from each side of the cross-lapping carriage to corresponding ones of the frame members during the transversely reciprocative movements of the cross-lapping carriage and they have essentially zero transverse movement relative to the portions of the layered web positioned therebeneath.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawing, in which:

Referring to FIGS. 1-5, an apparatus for forming a layered cross-lapped web from a strip of batt delivered thereto has been illustrated generally at 10. The apparatus 10 includes a pair of longitudinally spaced, transversely extending frame members 12 and 14 (FIG. 4) which are supported by corresponding pairs of vertically extending pedestal frame members, one of which is shown at 16 at the entry end of the apparatus and another of which is shown at 18 at the delivery end of the apparatus. As used herein, the terms "transverse" and "transversely" have reference to generally horizontal directions lying in the plane of the paper, as viewed in FIGS. 1-3, while the terms "longitudinal" and "longitudinally" have reference to directions that are generally perpendicular to the plane of the paper, as viewed in FIGS. 1-3.

Figure 1:
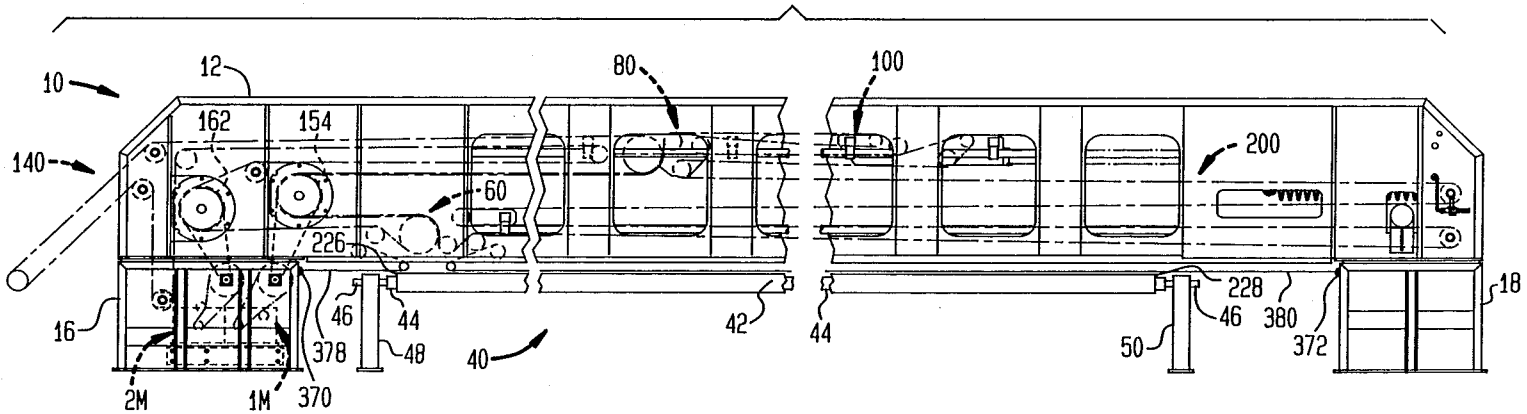
FIG. 1 is an elevation view, with parts broken away for clarity, of apparatus in accordance with this invention.

The various frame members 12-18 are rigidly interconnected to one another by a plurality of longitudinally extending braces, three of which are shown at 20, 22 and 24 (FIG. 4), and a plurality of diagonally extending struts, four of which are shown at 26, 28, 30 and 32, which rigidly interconnect the ends of various of the braces 20-24 to the mid points of adjacent braces 20-24 to provide added stability to the overall frame structure. Numerous other braces and struts are employed in the apparatus 10 but have been omitted from the drawings in order to allow the remainder of the apparatus 10 to be illustrated more clearly.

A longitudinally extending delivery conveyor, shown generally at 40, is positioned between the pedestal frame members 16 and 18, below the transversely extending frame members 12 and 14. The delivery conveyor 40 includes a longitudinally movable endless conveyor belt 42 that is suitably supported by a plurality of rollers, one of which is shown at 44, so as to provide an upwardly facing web support surface that extends beneath and longitudinally beyond the frame members 12 and 14. Suitable drive means (not shown) are employed to longitudinally move the upper reach of the belt 42 beneath the frame members 12 and 14. The rollers 44 are carried by corresponding shafts 46 which are journaled in bearings (not shown) carried by pedestals 48 and 50 at opposite ends of the shafts 46.

The apparatus 10 includes a lower, movable cross-lapping carriage assembly, shown generally at 60, which is slidably supported between the frame members 12 and 14 on rails, one of which is shown at 62, fixed to each of the frame members 12 and 14. Referring to FIGS. 6-9, the carriage assembly 60 includes a pair of longitudinally spaced walls, one of which is shown at 64, which are supported on the rails 62 by means of brackets 66 and slide bearings 68 in a manner that allows the carriage assembly to be reciprocated transversely on the rails 62. The transversely spaced walls 64 of the carriage assembly 60 are rigidly interconnected by suitable braces (not shown) and support between them a plurality of idler rollers 70, 72, 74, 76 and 78 which are journaled at their ends in bearings (not shown) carried by the walls 64.

Figure 2:
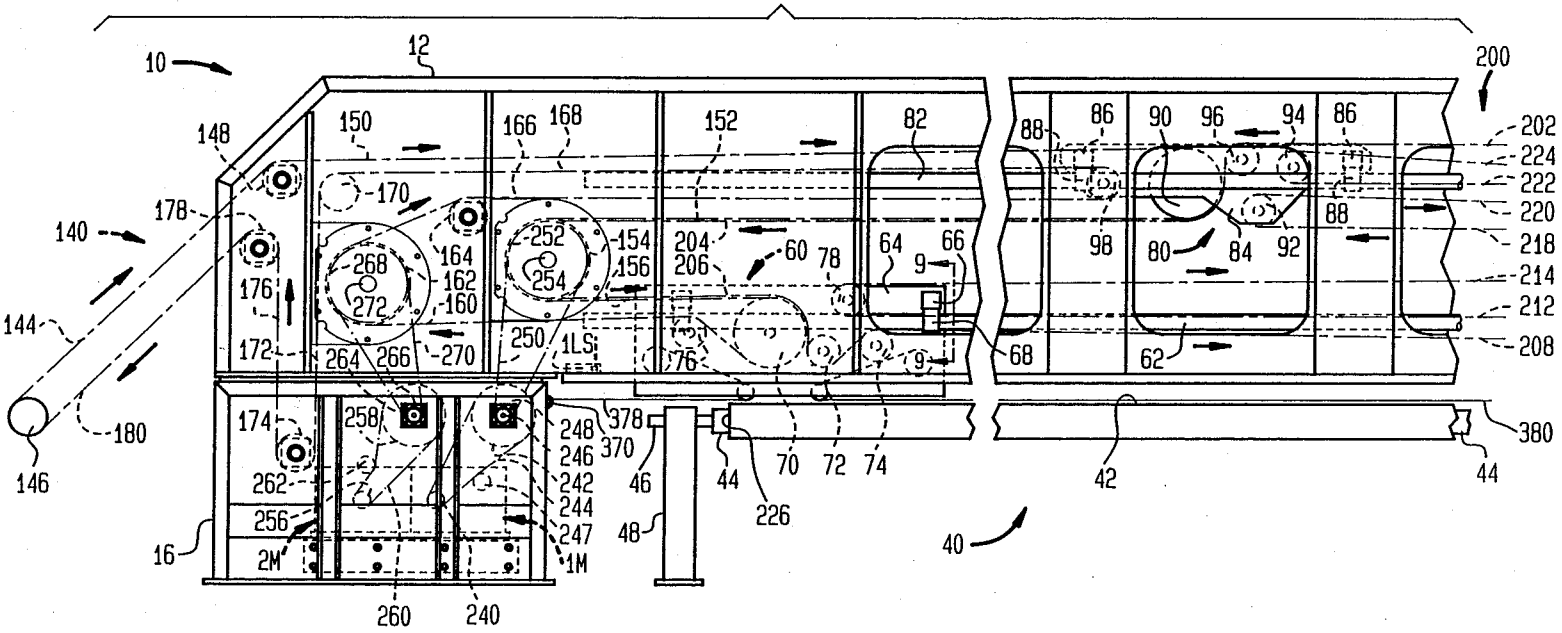
FIG. 2 is an enlarged elevation view similar to FIG. 1, with parts broken away for clarity, showing details of the entry end of the apparatus and showing the cross-lapping carriage near the end of its stroke adjacent the entry end of the apparatus.

The apparatus 10 also includes an upper movable carriage assembly, shown generally at 80, which is slidably supported between the frame members 12 and 14 on rails 82 and 83 (FIG. 4), respectively. Referring to FIG. 2, the carriage assembly 80 includes a pair of longitudinally spaced walls, one of which is shown at 84, which are supported on the rails 82 and 83 by means of brackets 86 and slide bearings 88 in a manner that allows the carriage assembly 80 to be reciprocated transversely on the rails 82 and 83. The longitudinally spaced walls 84 of the carriage assembly 80 are rigidly interconnected by suitable braces (not shown) and support between them a plurality of idler rollers 90, 92, 94, 96 and 98 which are journaled at their ends in bearings (not shown) carried by the walls 84. Upper movable carriage assembly 80 is therefore slidably movable along the rails 82 and 83 in the same manner that the lower movable carriage 60 is slidably movable relative to the rails 62.

Figure 3:
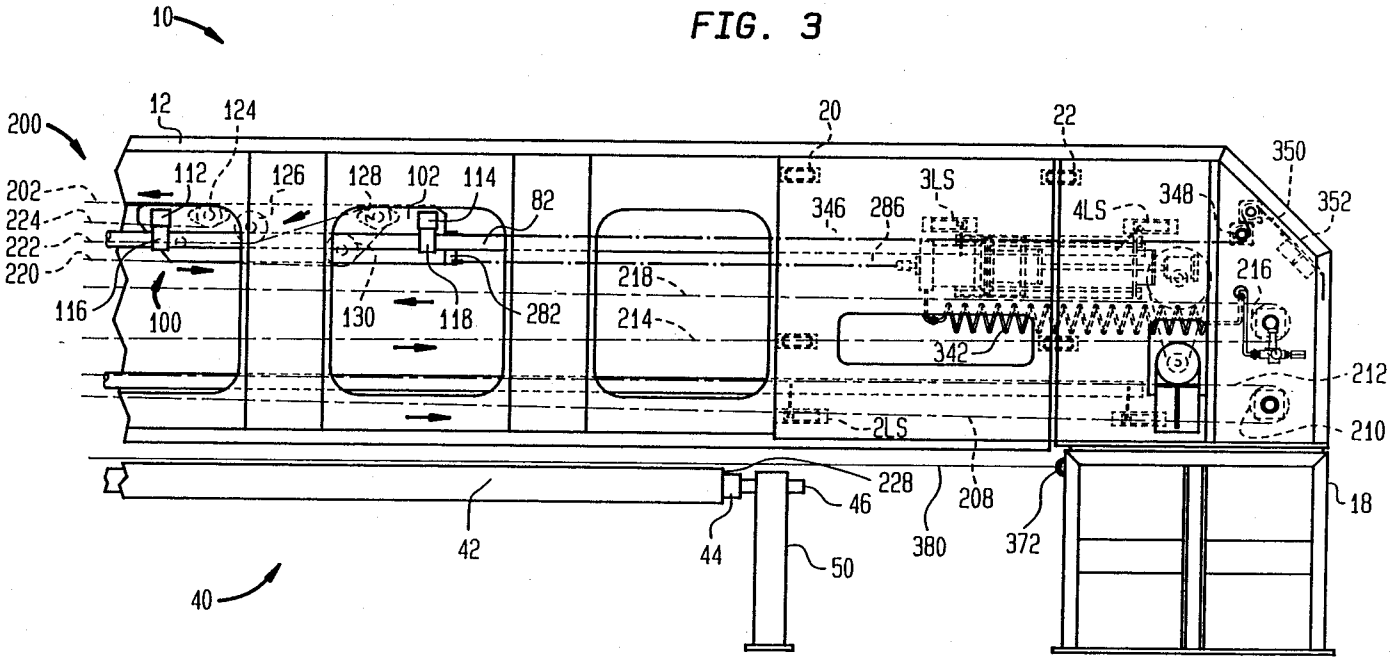
FIG. 3 is an enlarged elevation view, similar to FIG. 1, with parts broken away for clarity, showing details of the delivery end of the apparatus.
Figure 4:
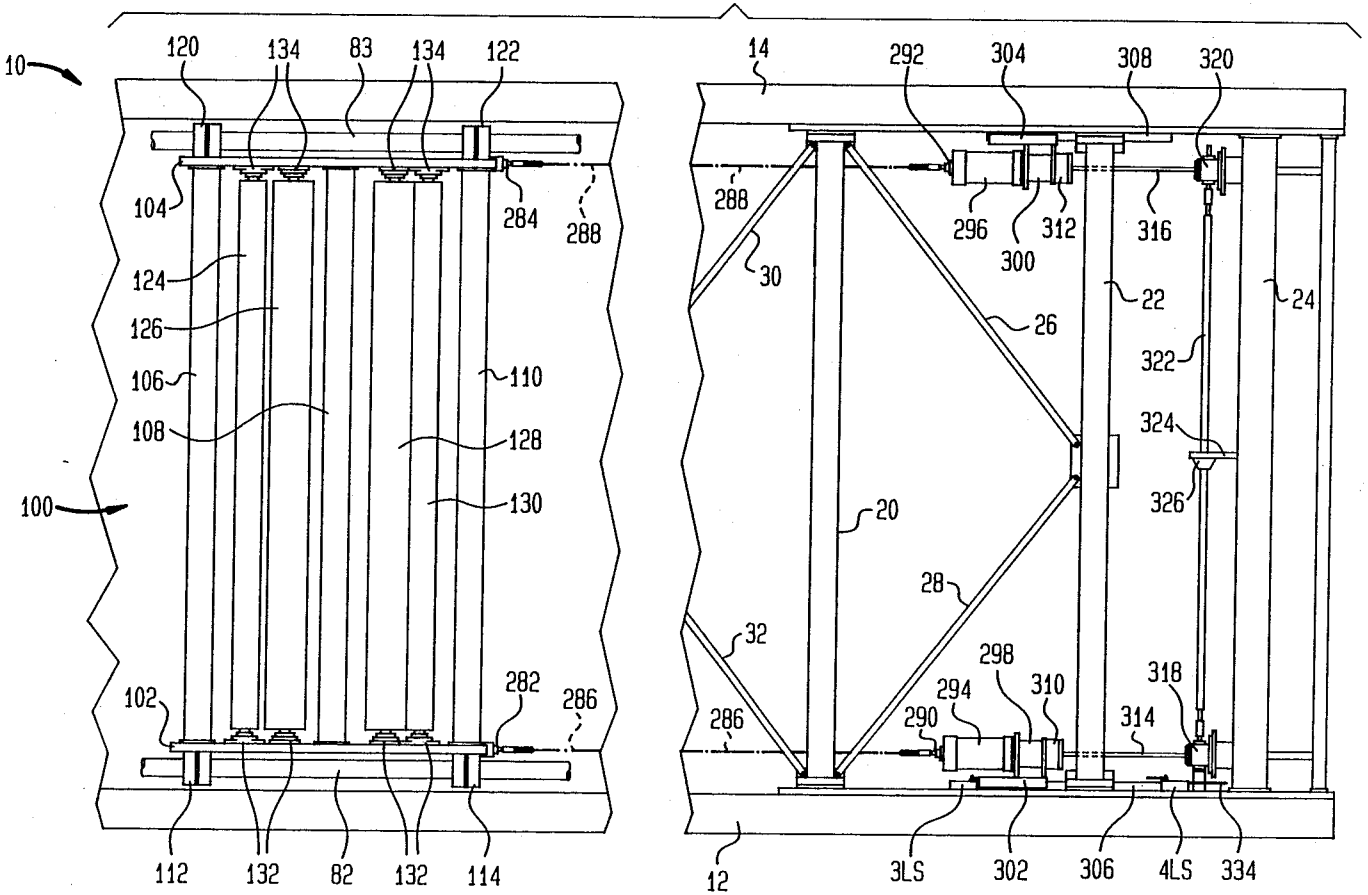
FIG. 4 is a plan view, with parts broken away for clarity, of the portion of the apparatus shown in FIG. 3.

The apparatus 10 includes yet another carriage assembly, shown generally at 100, which is also slidably supported between the frame members 12 and 14 on the upper rails 82 and 83. Referring more particularly to FIGS. 3 and 4, the carriage assembly 100, which is employed in a guide conveyor tensioning system to be described in greater detail hereinafter, includes a pair of longitudinally spaced walls 102 and 104 which are rigidly interconnected to one another in spaced apart relationship by means of cross braces 106, 108 and 110. The wall 102 is supported on rail 82 by means of brackets 112 and 114 which, in turn, support respective bearings 116 and 118 that slidably engage the rail 82. Similar brackets 120 and 122, which are fixed to the wall 104 and carry bearings (not shown) that slidably engage the rail 83, are employed to support the wall 104 from the rail 83. The transversely spaced walls 102 and 104 support between them a plurality of idler rollers 124, 126, 128 and 130 which are journaled at one of their ends on wall 102 by means of bearings 132 and are journaled at the other of their ends on wall 104 by means of bearings 134.

Figure 5:
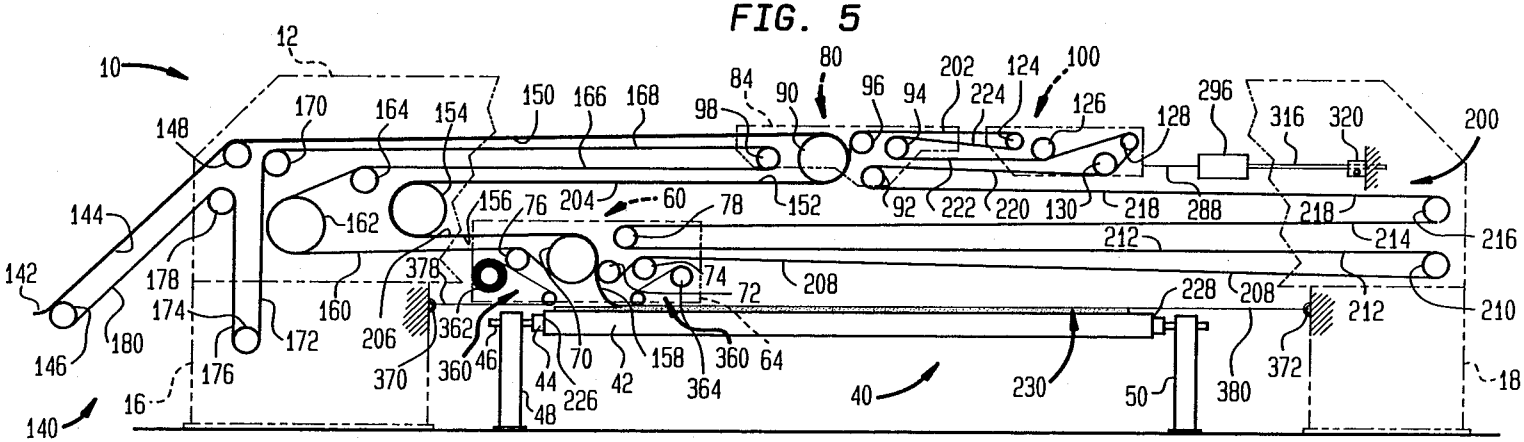
FIG. 5 is schematic elevation view, showing the manner in which the various guide conveyors of the apparatus are supported and driven.

Referring to FIGS. 2 and 5, the apparatus 10 includes a guide conveyor, shown generally at 140, that is entrained about various of the rollers of carriages 60 and 80 and serves to receive a strip of batt 142 from a let-off device (not shown) adjacent the entry end of apparatus 10 and to guide the strip of batt to and through the upper and lower carriages 80 and 60 for ultimate delivery to the delivery conveyor 40. Guide conveyor 140 is an endless conveyor belt that includes a first reach 144 which extends between idler rollers 146 and 148. Idler roller 148 extends between and is journaled on the frame members 12 and 14 and idler roller 146 is journaled between arms (not shown) that are pivotally mounted on and extend from the frame members 12 and 14 to allow the reach 144 of guide conveyor 140 to be moved into and out of a cooperative relationship with the let-off device that supplies the strip of batt to the apparatus 10. Guide conveyor 140 includes a second reach 150 that extends from idler roller 148 to the idler roller 90 of upper carriage 80. Conveyor 140 wraps around idler roller 90 and then proceeds along a third reach 152 to a drive roller 154. The guide conveyor 140 then wraps around the drive roller 154 and passes through another reach 156 to the roller 70 of the lower movable carriage 60.

The batt strip 142 that is delivered to the first reach 144 of guide conveyor 140 is carried by the guide conveyor through the various reaches 150, 152 and 156 and ultimately exits from the lower movable carriage 60, as shown at 158. Carriage 60 transversely reciprocates above the delivery conveyor 40, which is moving longitudinally relative to the carriage 60, so that as the carriage 60 reciprocates and delivers batt 142, consecutive transverse folds of the strip of batt are delivered on to the delivery conveyor 40. The relationship of the speed of the delivery conveyor to the speed of the cross-lapping movable carriage 60 determines the amount of overlap and, thus, the ultimate thickness of the cross-lapped web that is formed on the delivery conveyor 40. The manner in which the movable carriage 60 is controlled will be discussed in greater detail hereinafter.

Guide conveyor 140, after proceeding around the roller 70 of carriage 60 passes over idler roller 76 of the carriage and then proceeds through a reach 160 to a second drive roller 162. The drive rollers 162 and 154 are individually controllable and may be driven or braked separately from one another, or jointly with one another, in connection with moving the carriage 60 in one direction, or in another direction, or not at all, as will appear in greater detail hereinafter.

From the drive roller 162, guide conveyor 140 proceeds about an idler roller 164 carried by the frame members 12 and 14 and thence via a reach 166 to and about the idler roller 98 of upper movable carriage 80. From roller 98, the guide conveyor proceeds along a reach 168 to and about an idler roller 170 and thence through a reach 172 to and about an idler roller 174. The idler rollers 170 and 174 are journaled on the frame members 12 and 14. From idler roller 174, the guide conveyor 140 passes through a reach 176 and about a roller 178 journaled in frame members 12 and 14 and thence through a reach 180 back to the idler roller 146 to complete its endless loop.

Referring to FIGS. 2, 3 and 5, the apparatus 10 also includes a second guide conveyor, shown generally at 200, which includes a reach 202, extending from the roller 124 of guide conveyor tensioning carriage 100 to the roller 96 of upper movable carriage 80 and thence around roller 96 and roller 90 to a second reach 204 that extends between roller 90 and the drive roller 154. The reaches 152 and 204 enclose between them the strip of batt 142 that is delivered to the upper movable carriage 80 by the reaches 144 and 150 of the first guide conveyor 140.

After passing around drive roller 154, the guide conveyor 200 proceeds through a reach 206, with the batt strip 142 trapped between the reach 206 and reach 156 of guide conveyor 140, to the idler roller 70 of lower movable carriage 60. After passing around roller 70, the guide conveyor 200 passes around rollers 72 and 74 of the lower carriage 60 and then into a reach 208 that extends between roller 74 of carriage 60 and a roller 210 that is journaled between the frame members 12 and 14. The rollers 70 and 72, and the portions of respective guide conveyors 140 and 200 entrained about them, provide a longitudinally extending opening at the bottom of movable carriage 60 from which the batt strip 142 exits, as shown at 158, in connection with depositing the transverse folds of batt strip onto the delivery conveyor 40.

From roller 210, the guide conveyor 200 extends back toward the lower movable carriage 60 along a reach 212 and wraps around the roller 78 on carriage 60. Belt 200 then proceeds from roller 78 along a reach 214 to another idler roller 216 journaled between the frame members 12 and 14. After entraining about idler roller 216, the guide conveyor 200 proceeds through another reach 218 back to the upper movable carriage 80, around the roller 92 of that carriage, and back through another reach 220 to and about the respective rollers 130, 128 and 126 of the guide conveyor tension carriage 100. From roller 126, the guide conveyor 200 passes back to the upper movable carriage 80 via a reach 222, around the idler roller 94 of that carriage and back through a reach 224 to and about the idler roller 124 of the carriage 100, completing its endless circuit.

Assuming that the guide conveyors 140 and 200 are threaded about their respective rollers as shown in FIG. 5 and that the guide conveyor tension carriage assembly 100 is biased to the right (in a manner to be described in greater detail hereinafter) so as to insure that the guide conveyors 140 and 200 are properly tensioned about their various idler rollers and drive rollers, the manner in which the guide conveyors 140 and 200 are driven to deliver the strip of batt 142 in cross-lapped relationship to the delivery conveyor 40 will now be considered. As shown in FIG. 5, the lower movable carriage 60, which constitutes a portion of the cross-lapping means for delivering consecutive transverse folds of the strip of batt to the delivery conveyor, is moving to the left. This movement is caused by the drive roller 162 being rotated clockwise while the drive roller 154 is being braked. At the same time, and to accommodate the movement to the left of the lower movable carriage 60, the upper movable carriage 80 is moving to the right at one-half the speed that the lower carriage is moving to the left. The movement of the upper carriage 80 is caused by the interconnections of the various reaches of belts 140 and 200 with the various idler pulleys on the carriages 60, 80 and 100 and on the frame members 12 and 14.

When the lower carriage 60 reaches the end of its stroke toward the entry end of the apparatus 10, the lower forward portion of its wall 64 actuates a limit switch 1LS (FIG. 2) carried by the frame member 12 which is connected into the electrical circuits of the apparatus 10 and causes the motor driving the roller 162 to stop and become braked and causes the motor driving the roller 154 to start driving that roller in a counter-clockwise direction. This results in the initiation of movement of lower carriage 60 to the right, as viewed in FIG. 5, and in movement of the upper carriage 80 to the left, at half the speed that lower carriage 60 moves to the right. Accordingly, the strip of batt 142 which exits at 158 from lower movable carriage 60 starts overlapping the previously deposited layer of batt on delivery conveyor 40 in an amount determined by the relationship of the linear longitudinal speed of the delivery conveyor 40 to the linear transverse speed of the moving carriage 60.

When the carriage 60 approaches the right hand side of the delivery conveyor 40 (as viewed in FIG. 5), the leading edge of the wall 64 of the lower carriage actuates a limit switch 2LS (FIG. 3) carried by the frame member 12 which limit switch, in turn, signals the electrical circuits to stop and to brake the motor that drives roller 154. It also signals the electrical circuits to reenergize the motor that drives roller 162 so as to start another transverse stroke that moves lower carriage 60 from the delivery end of the apparatus 10 toward the entry end of the apparatus. Thus, a layer of cross-lapped web, shown generally at 230, is formed from a strip of batt that is delivered to the apparatus, the layered cross-lapped web being formed between side edges 226 and 228 of the longitudinally movable upwardly facing web support suface of the delivery conveyor 40.

Referring more particularly now to FIG. 2, the drive roller 154 is driven by a motor, shown generally at 1M, through a belt and pulley system that includes a drive pulley 240 carried on the output shaft (not shown) of motor 1M and a driven pulley 242 that is driven by pulley 240 via a toothed belt 244 and is carried on a spur shaft 246 journaled on the pedestal frame member 16. An idler pulley 247 carried by the frame member 16 bears against the toothed belt 244 to insure that the belt is appropriately tensioned between the pulleys 240 and 242. Shaft 246 carries a small driven pulley 248 that drives another toothed belt 250 which, in turn, is entrained about a large driven pulley 252 carried on a shaft 254 on which drive roller 154 is keyed. The arrangement is such that when motor 1M is energized to rotate pulley 240 the drive roller 154 rotates counterclockwise and, if drive roller 162 is braked at the time, the carriage 60 moves to the right and the carriage 80 moves to the left, at half the speed that the carriage 60 moves to the right.

Drive roller 162 is driven by a motor, shown generally at 2M, the output shaft (not shown) of which drives a drive pulley 256 which, in turn, rotates a driven pulley 258 via a toothed belt 260. An idler pulley 262 serves as a belt tightener for belt 260, and the pulley 258 is supported on a spur shaft 264 which also carries a small drive pulley 266 that drives a large pulley 268 via a toothed belt 270. The large pulley 268 is carried by a shaft 272 on which the drive roller 162 is keyed. The arrangement is such that when motor 2M is energized, the drive roller 162 rotates clockwise and, assuming drive roller 154 is braked at the time, this causes the lower carriage 60 to move to the left, as viewed in FIG. 2, and causes the upper carriage 80 to move to the right, as viewed in that figure, at a linear speed that is one-half of the linear speed of the lower carriage 60.

An alternative arrangement for driving and braking the drive rollers 154 and 162 would involve the use of a single drive motor (not shown), rather than the two drive motors 1M and 2M. The single drive motor would, in turn, alternately drive the drive pulleys 240 and 256 through a differential gear box (not shown) having two output shafts on which the drive pulleys are carried. The output shafts would be alternately braked to achieve the requisite reversals of the directions of movement of lower carriage 60 and upper carriage 80.

Referring to FIGS. 3–6, the manner in which the guide conveyors 140 and 200 are tensioned by the guide conveyor tensioning system carriage 100 will now be considered in greater detail. As indicated earlier, the carriage 100 is mounted on the rails 82 and 83 for sliding movement with respect thereto. The right end (as viewed in FIG. 4) of the side walls 102 and 104 of carriage 100 are provided with respective brackets 282 and 284 that are fixed thereto. The lower portions of brackets 282 and 284 each have one end of respective chains 286 and 288 fastened thereto. The other ends of the chains 286 and 288 are fastened to the protruding ends of respective piston rods 290 and 292 of respective pneumatically actuated cylinders 294 and 296. The cylinders 294 and 296 are carried by respective brackets 298 and 300 that, in turn, are supported on respective slides 302 and 304 which are movable on respective guideways 306 and 308.

The sides of brackets 298 and 300 opposite to those that support the cylinders 294 and 296 carry respective blocks 310 and 312 thereon. The blocks 310 and 312 fixedly support threaded lead screws 314 and 316 thereon that, in turn, are threadedly engaged by drive nuts 318 and 320 which are supported by brackets (not shown) depending from the brace 24 that interconnects the frame members 12 and 14.

Figure 6:
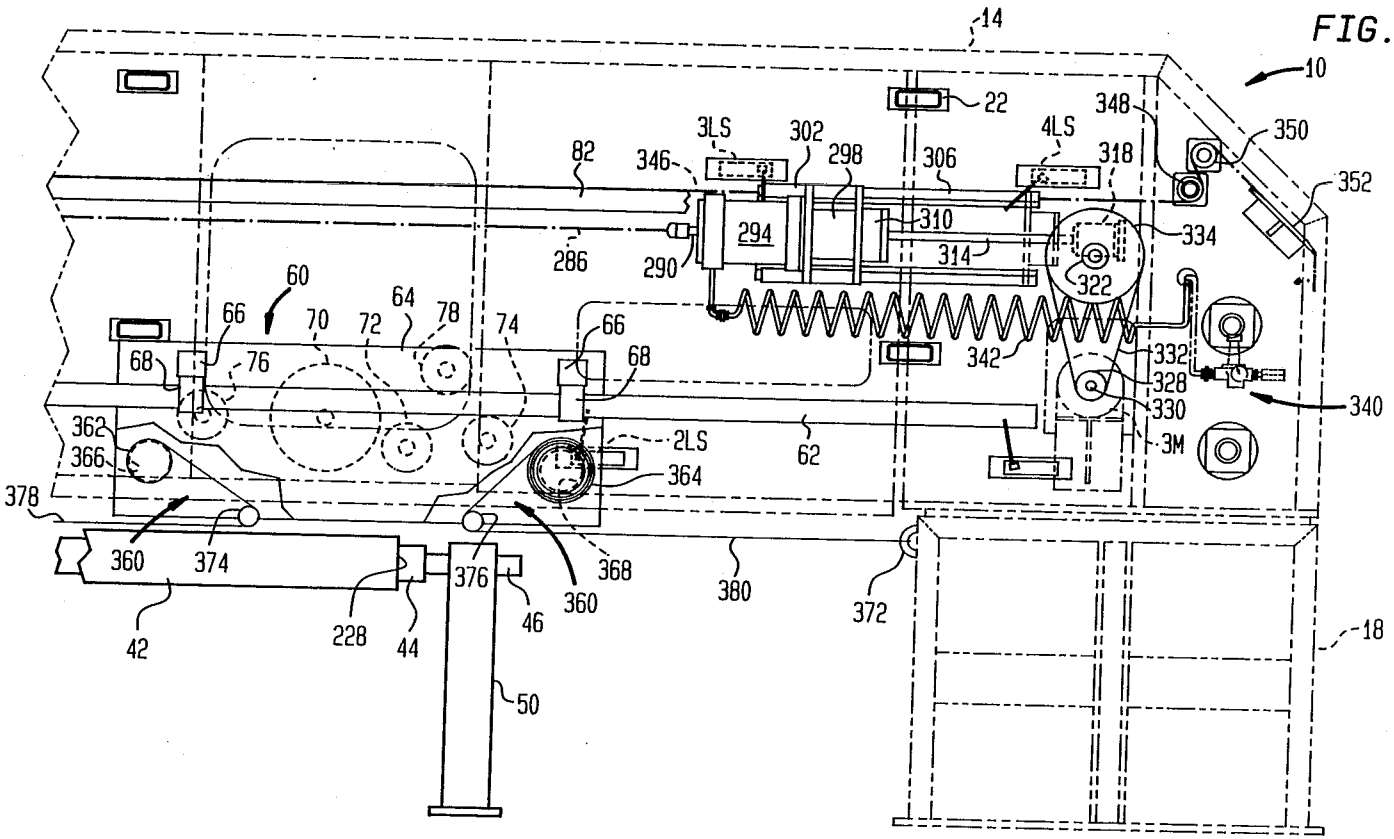
FIG. 6 is an enlarged elevation view, similar to FIG. 3, with parts omitted for clarity, showing the cross-lapping carriage at the end of its stroke adjacent the delivery end of the apparatus.

The drive nuts 318 and 320 are in threaded engagement with the respective lead screws 314 and 316 and, in turn, are driven by worm gears (not shown) that are rotated by a common shaft 322. The shaft 322 is supported from the brace 24 via a bracket 324 and bearing 326. Referring to FIG. 6, shaft 322 is rotated by a motor 3M via a pulley 328 carried on the output shaft 330 of motor 3M, a toothed belt 332 and a driven pulley 334 that is keyed to the shaft 322. Motor 3M is rotatable in both a clockwise direction and a counterclockwise direction so that the drive nuts 318 and 320 may be rotated either to increase or decrease the lengths of the lead screws 314 and 316 extant between the drive nuts 318, 320 and the blocks 310, 312. The rotation of the drive nuts 318, 320 via motor 3M, thus, is employed to move the slides 302 and 304 relative to their guides 306 and 308 and this, in turn, correspondingly moves the pneumatic cylinders 294 and 296.

In normal operation, after the guide conveyors 140 and 200 have been properly threaded about their respective rollers to set up the apparatus 10, the motor 3M is energized in a direction to pull the pneumatic cylinders 294 and 296 to the right, as viewed in FIG. 4, to preliminarily take up the slack in the guide conveyors. When the preliminary slack has been removed from the guide conveyers, the pneumatic cylinders 294 and 296 are pressurized via a pneumatic control system that includes a pressure regulator, shown generally at 340, and coiled flexible conduits, one of which is shown at 342, to retract the piston rods 290 and 292 about 2 inches into their respective pneumatic cylinders 294 and 296 to apply a predetermined tension to the guide conveyors 140 and 200. The pressure regulator 340 preferably provides compressed air in the range of 30 to 40 pounds per square inch to the cylinders 294 and 296 to accomplish the predetermined tensioning of the guide conveyors. Back up chains, one of which is shown at 346, having one of their ends connected to the upper portions of the corresponding brackets 282 and 284 and the other of their ends passing about a ratchet pulley 348 and an idler pulley 350 are employed to prevent inadvertent release of the guide conveyor tensioning system carriage 100 via operation of motor 3M. Ratchet pulley 348 may be manually rotated by a crank (not shown) to take up slack in the chain 346 and includes a pawl (not shown) which prevents reverse rotation of the pulley without the pawl being manually disengaged from the pulley. The chain 346 after passing about the pulleys 348 and 350 passes over a bracket 352. Limit switches 3LS and 4LS are positioned on frame member 12 adjacent to opposite ends of the guide 306. The limit switches 3LS and 4LS are actuated by the slide 302 at opposite ends of the travel of the cylinder 294 with respect to the guide 306, and are connected in the electrical control circuits of motor 3M to prevent the motor from driving slide 302 and cylinder 294 beyond the limits of the guide 306.

In setting up the apparatus 10, the motor 3M is initially manually energized to preliminarily tension the guide conveyors 140 and 200 prior to the time that the pneumatic cylinders 294 and 296 are pressurized. When the slack in guide conveyors 140 and 200 has been taken up, motor 3M is de-energized and braked and the slack in chain 346 is then manually taken up by the ratchet roller 348 to prevent the tension that is subsequently applied to the guide conveyors 140 and 200 by cylinders 294 and 296 from backdriving the motor 3M in the event that braking power for the motor is inadvertently lost.

As indicated earlier herein, one disadvantage of conventional apparatus for manufacturing cross-lapped webs results from the reciprocation of the movable carriages used in such apparatus and, in particular, from the reciprocation of the lower cross-lapping carriages of such apparatus, which generates air eddies above the delivery conveyor, producing eddying of the web on the conveyor and irregularities in the density profile of the web.

Referring now more particularly to FIGS. 5–8, apron means, shown generally at 360, carried by the cross-lapping carriage 60 in a position juxtaposed above the cross-lapped web 230 on the delivery conveyor 40, are provided for shielding portions of the web adjacent to the cross-lapping carriage 60 from air eddies caused by the transverse reciprocative movement of the cross-lapping carriage 60. The apron means 360 includes first and second apron members or belts 362 and 364, respectively, that are carried on respective reels or rollers 366 and 368 rotatively supported between the end walls 64 of the carriage 60.

The apron member 362 is spirally would about the reel 366 and has its inner end (not shown) fastened thereto. The apron member 364 is spirally wound about the reel 368 and has its inner end (not shown) fixed to that reel. The opposite ends of the apron members 362 and 364 are fastened to the respective pedestal members 16 and 18 at 370 and 372, respectively. The apron member 362 is entrained about a roller 374 in passing from the reel 362 to the pedestal member 16 via a reach 378. Roller 374 is rotatably supported between the end walls 64 of carriage assembly 60. Similarly, apron member 368 is entrained about a roller 376 in passing from its reel 364 to the pedestal member 18 via a reach 380. Roller 376 is also rotatably supported between the end walls 64 of the carriage assembly 60.

Figure 7:
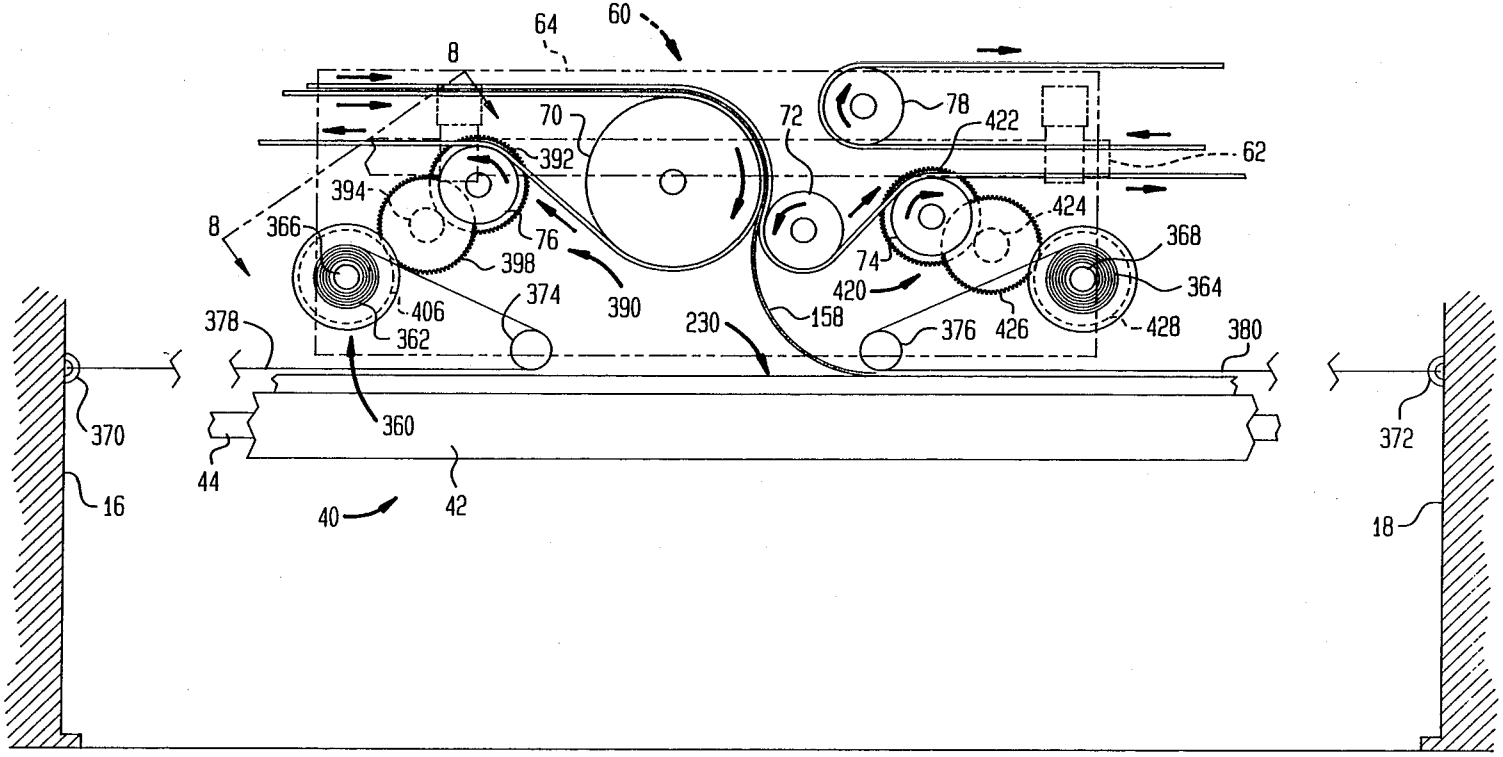
FIG. 7 is a diagrammatic elevation view, showing the manner in which shielding aprons carried by the cross-lapping carriage are wound onto and unwound from their respective support reels.

Referring to FIG. 7, and assuming that the carriage assembly 60 is moving to the left as viewed in that figure and that the carriage assembly 60 is approximately in the middle of its travel relative to the delivery conveyor 40 thereunder, the reel 366 will be rotating counter clockwise and winding apron member 362 onto itself, and the reach 378 of that apron member will shorten as the carriage assembly 60 moves toward the pedestal member 16. On the other hand, the reel 368 will be rotating counter clockwise and unwinding apron member 364 from itself, and the reach 380 of that apron member will increase in length as the carriage assembly 60 moves away from the pedestal member 18. When the carriage assembly 60 completes its leftward stroke as viewed in FIG. 60 and moves to the right in connection with its movement toward the pedestal member 18, the reverse actions occur and the apron member 364 winds onto its reel 368, shortening the reach 380, while the apron member 362 unwinds from the reel 366, elongating its reach 378. Thus, the reaches 378 and 380 are variable length portions of the apron 362 and 364 which extend from each side of the cross-lapping carriage 60 to corresponding ones of the pedestal members 16 and 18 during the transversely reciprocative movements of the cross lapping carriage. Moreover, it is noted that, regardless of the direction of movement of the carriage assembly 60, the reaches or variable length portions 378 and 380 of the apron members 362 and 364 have essentially zero transverse movement relative to the portions of the layered web 230 positioned therebeneath on the delivery conveyor 40.

Figure 8:
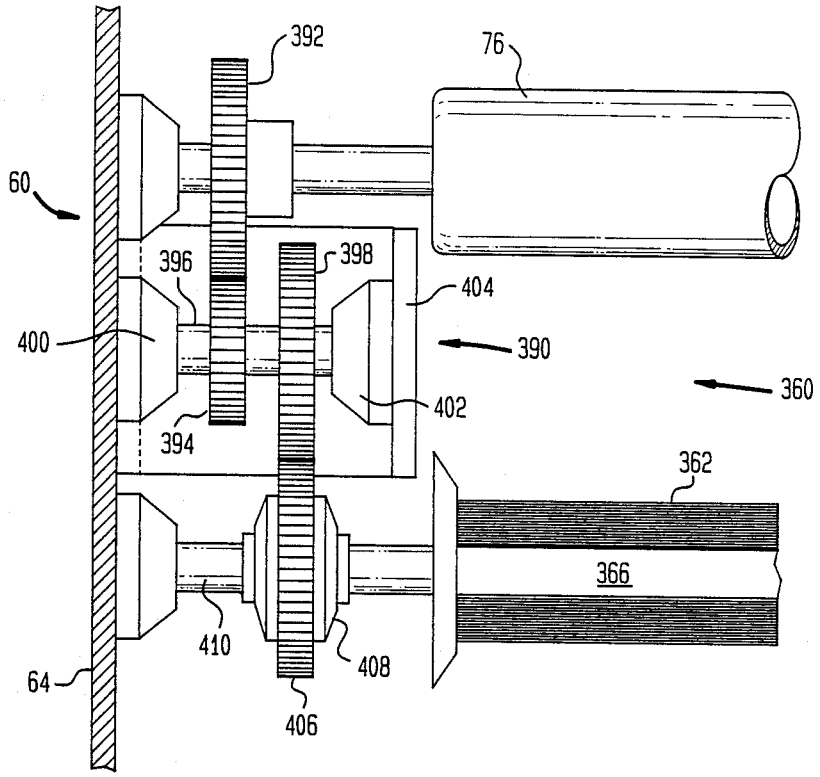
FIG. 8 is an enlarged sectional elevation view, taken along the line 8—8 of FIG. 7, showing details of a power take-off and slip clutch mechanism utilized in winding and unwinding the shielding aprons relative to their respective support reels.
Figure 9:
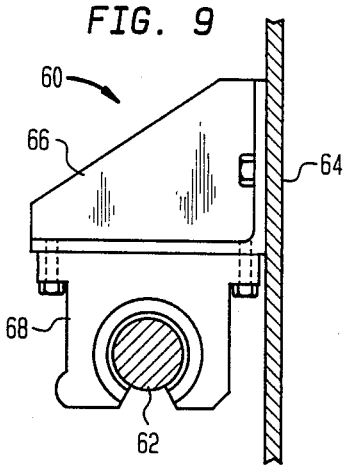
FIG. 9 is an enlarged sectional elevation view, taken along the line 9—9 of FIG. 2, showing details of a slide and guide arrangement used to movably support the various movable carriages of the apparatus on the frame of the apparatus.

Referring more particularly to FIGS. 7 and 8, means, shown generally at 390, are coupled to each of the reels 366 and 368 for applying a predetermined wind-up torque thereto. Each of the torque applying means 390 comprises a power train that derives rotational energy from one or the other rollers 74 and 76 of carriage assembly 60 and delivers the rotational power to corresponding ones of the reels 366 and 368. Thus, referring to FIG. 8, the shaft of roller 76 has a gear 392 that is keyed to it and rotatably carried by it. The gear 392 is in engagement with a gear 394 carried by and keyed to a spur shaft 396 that has a second gear 398 also keyed to it. The spur shaft 396 is supported in bearings 400 and 402 carried, respectively, by the wall 64 and a bracket 404 that is fastened to and projects from the wall 64. Gear 398 is in meshing engagement with yet another gear 406 that is carried on the outer periphery of a slip clutch 408 which, in turn, is keyed to and supported on a shaft 410 that rotatably carries the reel 366 on which apron member 362 is wound. The slip clutch 408, which is preferably a magnetic torque coupling device, transmits only enough torque therethrough to positively wind the apron member 362 onto the reel 366, and always provides torque in the same direction (i.e., the direction of winding the apron member onto the reel). One example of an appropriate mechanical slip clutch for the foregoing purpose is Model No. 250A-2, made by Morse Industrial Products Division of Borg Warner Corporation whose executive offices are at their Aurora Street Plant, Ithaca, N.Y. It is referred to as the DODGE TORQUETAMER. Other known slip clutches, of course, may be used in accordance with known practices in place of the foregoing slip clutch.

A similar torque applying means, shown generally at 420, is employed in connection with applying a predetermined wind up torque onto the reel 368 of apron member 364. The torque applying means 420 includes a plurality of interconnected gears, including the gears 422, 424, 426 and 428, which correspond to the gears 392, 394, 398 and 406, respectively. The torque applying means 420 also includes parts (not shown) corresponding to the spur shaft 396, the bearings 400 and 402, the bracket 404 and the slip clutch 408 of torque applying means 390.

Referring to FIGS. 5 and 7, the manner in which the apron members 362 and 364 are wound and unwound about their respective reels 366 and 368 during transverse reciprocative movement of the carriage 60 will now be considered in greater detail. It should be noted, initially, that during reciprocative movement of the carriage 60 relative to the delivery conveyor 40, the guide conveyors 140 and 200 constantly move in the same direction with respect to respective rollers 76 and 74 of carriage 60, regardless of the direction of movement of the carriage 60. Accordingly, the gear 392 of torque wind up means 390 is constantly turning counter clockwise, regardless of the direction of movement of the carriage 60, and the gear 422 of torque wind up means 420 is constantly turning clockwise, regardless of the direction of movement of the carriage 60. The direction of rotation of gear 392 is such that it tends to rotate the reel 366 counter clockwise through its gear train 394, 398 and 406.

When the carriage 60 is moving to the left, as viewed in FIG. 7, this results in the apron member 362 being wound up onto reel 366, since there is no back torque on the slip clutch tending to interfere with the direct transmission of the wind up force to the reel 366. On the other hand, during such movement to the left of carriage 60, the gear 422 of torque applying means 420 is attempting to wind apron member 364 onto reel 368 while the movement of the carriage tends to pull the apron member off of the reel, creating a high unwinding torque on the reel. The unwinding torque on reel 368 is sufficient to overcome the drag of the slip clutch so that, notwithstanding the rotation of gear 422 in a direction tending to wind the apron member 364 onto reel 368, the apron member unwinds from the reel.

The reverse action occurs when the carriage assembly 60 moves from left to right, as viewed in FIG. 7, with the apron member 364 winding onto the reel 368, and with the slip clutch 408 of torque applying means 390 slipping to allow the apron member 362 to unwind from the reel 366.

It will thus be seen from the foregoing discussion that at all times during the reciprocative transverse movement of the carriage 60 relative to the layered cross-lapped web 230 on the delivery conveyor, the reaches 378 and 380 of the respective apron members 362 and 364 extend between the outer portions of the carriage assembly 60 and the corresponding pedestal frame members 16 and 18 to shield the layered cross-lapped web on the delivery conveyor from air eddies generated by the movement of the carriage assembly above the delivery conveyor. Moreover, the reaches 378 and 380 of the apron members 362 and 364 that are in contact with the layered cross-lapped web 230 on the delivery conveyor are transversely static with respect to such layered web (i.e., they have essentially zero transverse movement relative to the portions of the layered web positioned therebeneath). Thus, the present invention facilitates the manufacture of layered cross-lapped web having a more uniform density profile therein than has heretofore been the case.

While there has been shown and described what is presently considered to be the preferred embodiment of this invention, it will be obvious to those skilled in the art that various changes and modifications may be made without departing from the broader aspects of this invention. It is, therefore, aimed in the appended claims to cover all such changes and modifications as fall within the true spirit and scope of this invention.

What is claimed is:

1. Apparatus for forming a layered, cross-lapped web of predetermined width from a strip of web material, comprising a pair of transversely spaced frame members, conveyor means having a web support surface positioned between said frame members and movable longitudinally relative thereto, cross-lapping means transversely reciprocatively movable relative to said conveyor means and adapted to deliver said strip of web material to said web support surface to form said layered cross-lapped web on said conveyor means, and apron means carried by said cross-lapping means and juxtaposed above said layered web for shielding portions of said web adjacent to said cross-lapping means from air eddies caused by said transverse reciprocative movement of said cross-lapping means, said apron means having variable length portions thereof extending from each side of said cross-lapping means toward corresponding ones of said frame members during the transverse reciprocative movements of said cross-lapping means, said variable length portions each having essentially zero transverse movement relative to the portions of said layered web positioned therebeneath.

2. Apparatus according to claim 1, wherein said cross-lapping means includes a longitudinally extending opening therein for delivering said strip of web material to said web support surface, and wherein said apron means includes first and second elongate, flexible strip members carried by said cross-lapping means at corresponding opposite sides of said opening, said strip members each extending from said cross-lapping means to a corresponding one of said frame members.

3. Apparatus according to claim 2, wherein said strip members are in contact with the portions of said web that are positioned therebeneath; and wherein said strip members each have an end portion thereof fixed to said corresponding one of said frame members.

4. Apparatus according to claim 3, wherein said variable length portions of said apron means comprise corresponding portions of said strip members, and wherein said apron means further includes first and second roller means positioned on said cross-lapping means at corresponding opposite sides of said opening for extending and retracting said variable length portions of said strip members relative to said cross-lapping means.

5. Apparatus according to claim 4, wherein said strip members wind onto and off of said corresponding roller means during the transverse reciprocative movements of said cross-lapping means.

6. Apparatus according to claim 5, and further including means coupled to each of said roller means for applying a predetermined wind-up torque thereto, said wind-up torque on each of said roller means serving to wind a corresponding one of said strip members onto said roller means during movement of said cross-lapping means toward said strip member and to allow said corresponding one of said strip members to unwind from said roller means during movement of said cross-lapping means away from said strip member.

7. Apparatus according to claim 6, wherein said torque applying means includes means carried by said cross-lapping means for rotating each of said roller means, said torque applying means further including first and second slip clutch means respectively coupled between said roller rotating means and said first and second roller means for limiting the amount of torque applied by said roller rotating means to each of said roller means.

8. Apparatus according to claim 7, wherein said cross-lapping means includes first and second conveyor means therein for delivering said strip of web material to said web support surface, and wherein said roller rotating means includes first and second gear trains carried by said cross-lapping means, said first and second gear trains being respectively coupled between said first and second conveyor means and said first and second slip clutch means.

* * * * *